US010182283B2

(12) United States Patent
Hsieh

(10) Patent No.: US 10,182,283 B2
(45) Date of Patent: Jan. 15, 2019

(54) NOISE CANCELLATION DEVICE AND NOISE CANCELLATION METHOD

(71) Applicant: Realtek Semiconductor Corporation, Hsinchu (TW)

(72) Inventor: Pei-Wen Hsieh, Kaohsiung (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 8 days.

(21) Appl. No.: 15/698,634

(22) Filed: Sep. 7, 2017

(65) Prior Publication Data

US 2018/0206022 A1 Jul. 19, 2018

(30) Foreign Application Priority Data

Jan. 17, 2017 (TW) ..... 106101549 A

(51) Int. Cl.
*G10K 11/178* (2006.01)
*H04R 1/10* (2006.01)

(52) U.S. Cl.
CPC ..... *H04R 1/1041* (2013.01); *G10K 11/178* (2013.01); *G10K 11/17817* (2018.01); *G10K 11/17833* (2018.01); *G10K 11/17881* (2018.01); *H04R 1/1083* (2013.01); *G10K 2210/1081* (2013.01); *H04R 2460/01* (2013.01)

(58) Field of Classification Search
CPC ..... H04R 1/1041; H04R 1/1083; H04R 2460/01; G10K 11/178; G10K 11/17833; G10K 11/17881; G10K 11/17817; G10K 2210/1081
USPC ..... 381/71.1, 71.6, 74
See application file for complete search history.

(56) References Cited

U.S. PATENT DOCUMENTS

| | | | | |
|---|---|---|---|---|
| 4,494,074 | A | 1/1985 | Bose | |
| 8,054,992 | B2 | 11/2011 | Sapiejewski | |
| 8,199,923 | B2 | 6/2012 | Christoph | |
| 8,306,240 | B2 * | 11/2012 | Pan | G10K 11/178 381/94.1 |
| 8,831,238 | B2 * | 9/2014 | Rashid | G10K 11/178 381/71.1 |
| 8,908,877 | B2 | 12/2014 | Abdollahzadeh Milani et al. | |
| 9,236,041 | B2 | 1/2016 | Asada et al. | |

* cited by examiner

*Primary Examiner* — David L Ton
(74) *Attorney, Agent, or Firm* — CKC & Partners Co., Ltd.

(57) ABSTRACT

A noise cancellation device includes an anti-noise filter circuit, an output circuit, and a detection circuit. The anti-noise filter circuit provides a corresponding one of transfer functions to process a digital signal, in order to generate a noise cancellation signal, in which the transfer functions are different from each other. The output circuit mixes the noise cancellation signal, a reference signal, and an input signal to generate a mixed signal, and generates a sound output signal based on the mixed signal, in which the digital signal is associated with the sound output signal. The detection circuit controls the anti-noise filter circuit to provide the corresponding one of the transfer functions according to a comparison result of a first ratio and a first threshold value, in which the first ratio is a ratio of a first power of the mixed signal to a second power of the digital signal.

20 Claims, 5 Drawing Sheets

NOISE CANCELLATION DEVICE AND NOISE CANCELLATION METHOD

RELATED APPLICATIONS

This application claims priority to Taiwan Application Serial Number 106101549, filed Jan. 17, 2017, which is herein incorporated by reference.

BACKGROUND

Technical Field

The present disclosure relates to a noise cancellation device. More particularly, the present disclosure relates to a noise cancellation device having a mechanism for detecting whether device is in an on-ear or an off-ear position and a method thereof.

Description of Related Art

In order to provide higher sound quality, an active noise cancellation mechanism is commonly applied to a headphone to reduce disturbances from environmental noises. In some approaches, the active noise cancellation mechanism is implemented with a single filter to generate a noise cancellation signal. However, when the headphone is not used, i.e., the headphone is in an off-ear position, the system response of the active noise cancellation mechanism would have a large variation. In order to keep the stability of the active noise cancellation mechanism, the single filter is limited to be implemented with circuits that provides higher stability but with lower noise cancellation quality. As a result, when the headphone is used, i.e., the headphone is in an on-ear position, the active noise cancellation mechanism cannot provide higher noise cancellation quality.

DETAILED DESCRIPTION

Figure 1:
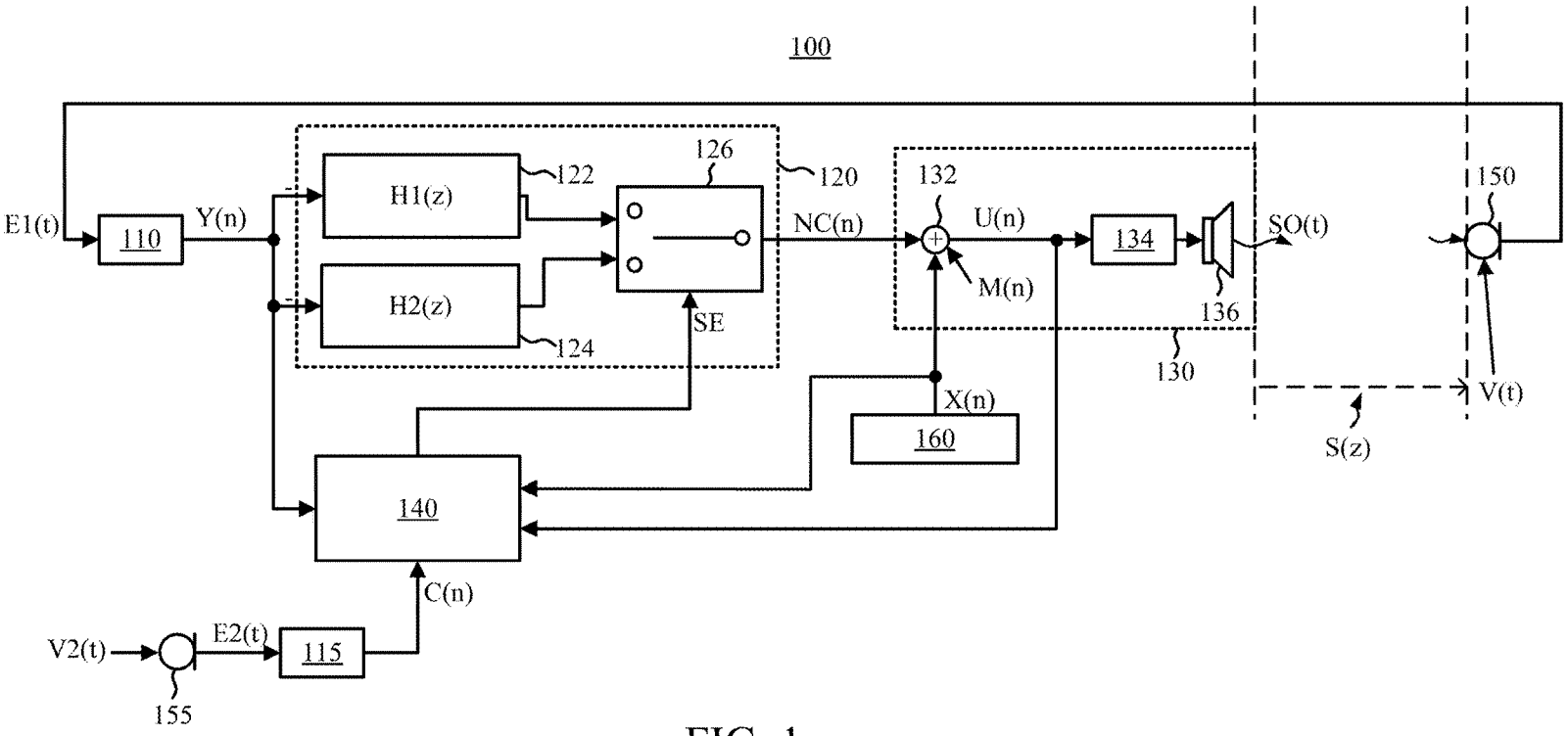
FIG. 1 is a schematic diagram of a noise cancellation device, according to some embodiments.

Referring to FIG. 1, in some embodiments, a noise cancellation device 100 is implemented on various electronic devices (e.g., headphones), in order to reduce disturbances from environmental noises.

In some embodiments, the noise cancellation device 100 includes analog-to-digital converters (ADCs) 110 and 115, an anti-noise filter circuit 120, an output circuit 130, a detection circuit 140, audio-to-electric conversion devices 150 and 155, and a reference signal generator 160.

In some embodiments, the audio-to-electric conversion device 150 is set in a shell of a headphone, and receives a sound output signal SO(t) and a noise signal V(t). The sound output signal SO(t) is transmitted to the audio-to-electric conversion device 150 via a transfer function S(z), and the transfer function S(z) is a transfer function between an electric-to-audio conversion device 136 and the audio-to-electric conversion device 150. The audio-to-electric conversion device 150 converts the received signal to an electrical signal E1(*t*). In some embodiments, the audio-to-electric conversion device 150 is implemented with a microphone, but the present disclosure is not limited thereto.

The ADC 110 converts the electrical signal E1(*t*) to a digital signal Y(n). The anti-noise filter circuit 120 is coupled to the ADC 110 to receive the digital signal Y(n).

The anti-noise filter circuit 120 provides one of a transfer function H1(*z*) and a transfer function H2(*z*) to process the digital signal Y(n), in order to generate a noise cancellation signal NC(n). For example, the anti-noise filter circuit 120 includes filters 122 and 124 and a switching circuit 126. The switching circuit 126 selects, according to a switching signal SE, an output of one of the filter 122 and the filter 124 as the noise cancellation signal NC(n). The filter 122 provides the transfer function H1(*z*), and the filter 124 provides the transfer function H2(*z*). In some embodiments, the switching circuit 126 is arranged between the ADC 110 and the anti-noise filter circuit 120, and the outputs of the filters 122 and 124 are coupled to the output circuit 130. In some embodiments, the switching circuit 126 is implemented with one or more switches. In some embodiments, the switching circuit 126 is implemented with a multiplexer circuit.

In some embodiments, the filters 122 and 124 are implemented with two independent filters. In some embodiments, the filter 122, the filter 124, and the switching circuit 126 are implemented with a single filter having adjustable parameters, in which the parameters of the filter are adjusted according to the switching signal SE to selectively provide the transfer function H1(*z*) or the transfer function H2(*z*). The implementations of the anti-noise filter circuit 120 are given for illustrative purposes only, and the present disclosure is not limited thereto.

The output circuit 130 includes an arithmetic circuit 132, a digital-to-analog converter (DAC) 134, and the electric-to-audio conversion device 136. The arithmetic circuit 132 is coupled to the switching circuit 126 to receive the noise cancellation signal NC(n), and mixes the noise cancellation signal NC(n), a reference signal X(n), and an input signal M(n) to generate a mixed signal U(n). In some embodiments, the arithmetic circuit 132 is implemented with circuits like an adder and/or a synthesizer. In some embodiments, the input signal M(n) is an audio signal outputted from an audio source via a synthesizer and/or an amplifier. The DAC 134 converts the mixed signal U(n). The electric-to-audio conversion device 136 is coupled to the DAC 134, and outputs the converted mixed signal U(n) as the sound output signal SO(t). In some embodiments, the electric-to-audio conversion device 136 is implemented with a speaker.

In some embodiments, the detection circuit 140 receives the digital signal Y(n), a digital noise signal C(n), the mixed signal U(n), and the reference signal X(n), and outputs, according to the received signals, the switching signal SE to control the switching circuit 126. The above operations will be described with FIG. 2 below.

In some embodiments, the noise cancellation device 100 further includes an ADC 115 and an audio-to-electric conversion device 155. In some embodiments, the audio-to-electric conversion device 155 is disposed at the shell of the headphone to receive a noise signal V2(*t*), and converts the same to an electrical signal E2(*t*). The ADC 115 is coupled to the audio-to-electric conversion device 155, and converts the electrical signal E2(*t*) to the digital noise signal C(n), in which the digital noise signal C(n) may be employed to estimate a power of a digital signal (which is expressed as a noise signal V2(*n*) hereinafter) to which the noise signal V2(*t*) corresponds.

In some embodiments, the noise signal V2(*n*) may be configured to estimate signal components, which have frequency similar with the frequency of the reference signal X(n), in a noise signal V(n), in which the noise signal V(n) indicates a digital signal to which the noise signal V(t) corresponds. As the reference signal X(n) is commonly set as a low frequency signal, and the low frequency signal penetrates through the shell of the headphone more easily, a signal strength of the noise signal V2(*n*) in a low frequency band generally corresponds to a signal strength of the noise signal V(n). Accordingly, in the following embodiments, the signal strength of the noise signal V2(*n*) is used as an analogy of the signal strength of the noise signal V(n).

In some embodiments, a voltage gain of the transfer function H1(*z*) is higher than that of the transfer function H2(*z*). In other words, the noise cancellation signal NC(n) generated from the transfer function H1(*z*) is higher than the noise cancellation signal NC(n) generated from the transfer function H2(*z*). Effectively, at each band, the filter 122 provides a better noise cancellation quality than the filter 124 does. In general, when the voltage gain of the filter is higher, the stability of the filter is lower. Alternatively stated, in this example, compared with the filter 122, the filter 124 has a better reliability but has a lower voltage gain. In some embodiments, the filter 122 is selected if the noise cancellation device 100 is in an on-ear position, and the filter 124 is selected if the noise cancellation device 100 is in an off-ear position.

In some approaches, in order to keep the noise cancellation system on a headphone being stable, a single filter, which has lower voltage gain, is utilized to increase the stability. However, in these approaches, the noise cancellation system cannot provide a better noise cancellation quality when the headphone is in the on-ear position. Compared with these approaches, by analyzing the digital signal Y(n), the noise signal V2(*n*), the mixed signal U(n), and the reference signal X(n), the detection circuit 140 determines whether the noise cancellation device 100 is in the on-ear or the off-ear position. As a result, in the on-ear position, the detection circuit 140 outputs the switching signal SE to select the filter 122, in order to improve the noise cancellation quality. Alternatively, in the off-ear position, the detection circuit 140 outputs the switching signal SE to select the filter 124, in order to keep the system being stable.

The reference signal generator 160 generates the reference signal X(n) to the arithmetic circuit 132. In some embodiments, a frequency of the reference signal X(n) is a frequency that cannot be sensed by human ear. For example, the frequency of the reference signal X(n) is about 10 hertz(Hz), but the present disclosure is not limited thereto. In some other embodiments, as discussed in FIG. 4A below, the reference signal X(n) may be periodically outputted.

In some embodiments, by using Z-transform to analyze the noise cancellation device 100, it is able to derive the following equation (1):

$$\left.\begin{aligned} Y(z) &= X(z)\left[\frac{S(z)}{1+S(z)H(z)}\right] + V(z)\left[\frac{1}{1+S(z)H(z)}\right] \\ U(z) &= X(z)\left[\frac{1}{1+S(z)H(z)}\right] + V(z)\left[\frac{H(z)}{1+S(z)H(z)}\right] \\ H(z) &= \begin{cases} H1(z), & \text{if on ear} \\ H2(z), & \text{if off ear} \end{cases} \end{aligned}\right\}. \tag{1}$$

where X(z) is a Z-transform of the reference signal X(n), Y(z) is a Z-transform of the digital signal Y(n), V(z) is a Z-transform of the noise signal V(n), U(z) is a Z-transform of the mixed signal U(n), and the transfer function S(z) is a transfer function between the electric-to-audio conversion device 136 and the audio-to-electric conversion device 150.

According to the equation (1), if the power of the reference signal X(n) is significantly higher than the power of the noise signal noise signal V(n), it is able to derive the following equation (2):

$$\left.\begin{aligned} Y(z) &\approx X(z)\left[\frac{S(z)}{1+S(z)H(z)}\right] \\ U(z) &\approx X(z)\left[\frac{1}{1+S(z)H(z)}\right] \end{aligned}\right\}. \tag{2}$$

According to the equation (2), under this condition, the ratio between Y(Z) and U(z) is the transfer function S(z), in which the transfer function S(z) has different values based on the noise cancellation device 100 being in the on-ear position or in the off-ear position. In some embodiments, in the on-ear position, the transfer function S(z) has a higher value. Alternatively, in the off-ear position, the transfer function S(z) has a lower value. Accordingly, the detection circuit 140 is able to determine, according to the ratio between Y(z) and U(z), whether the noise cancellation device 100 is in the on-ear or the off-ear position.

In addition, when the power of the reference signal X(n) is significantly lower than the power of the noise signal V(n), it is able to derive the following equation (3):

$$\left.\begin{aligned} Y(z) &\approx V(z)\left[\frac{1}{1+S(z)H(z)}\right] \\ U(z) &\approx V(z)\left[\frac{H(z)}{1+S(z)H(z)}\right] \end{aligned}\right\}. \tag{3}$$

According to the equation (3), under this condition, the ratio between Y(z) and U(z) is 1/H(z) instead of the transfer function S(z). Accordingly, the detection circuit 140 is able to determine, according to the ratio between Y(z) and U(z), whether the noise cancellation device 100 is in an unknown position.

Figure 2:
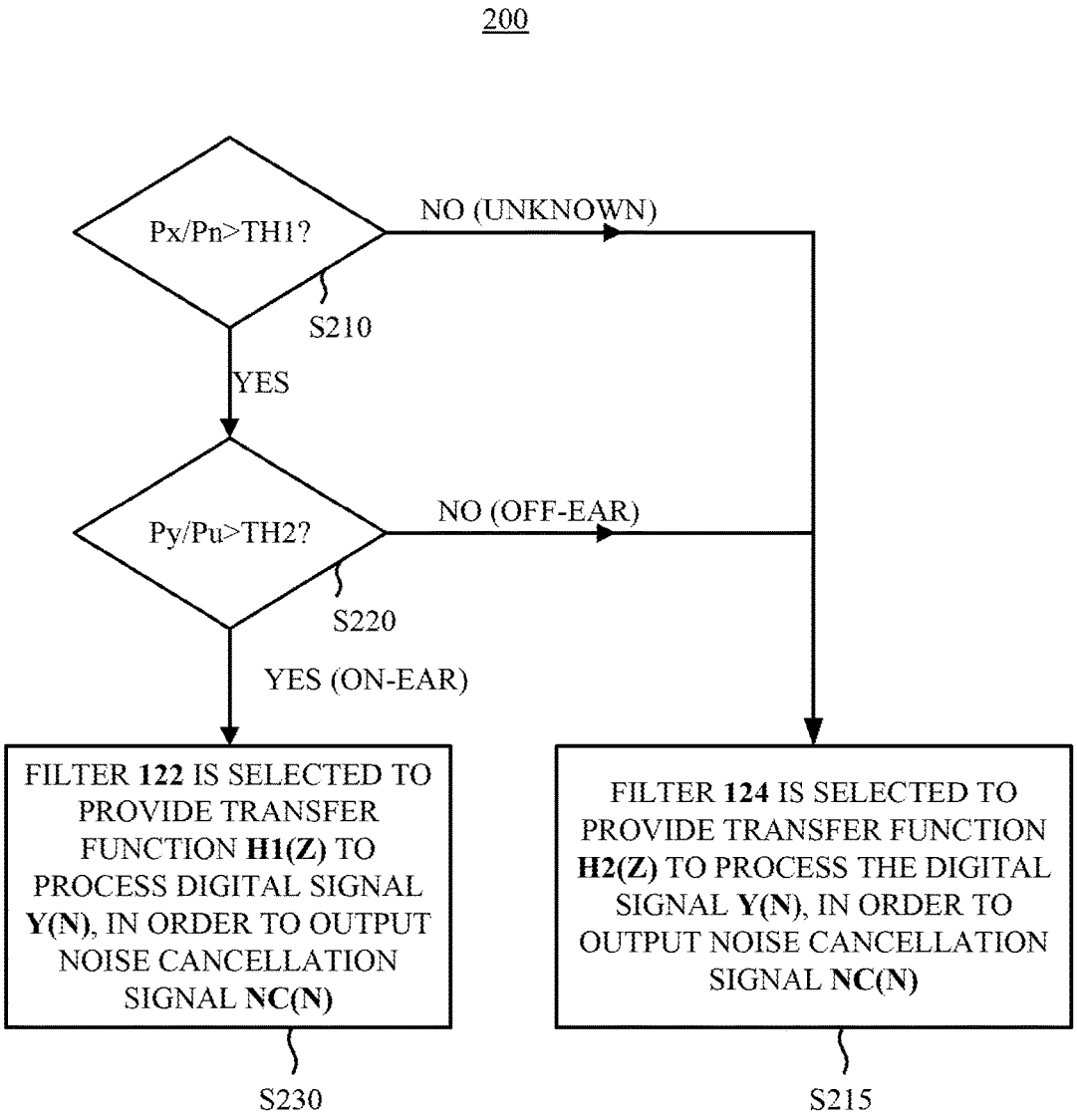
FIG. 2 is a flow chart of a method, performed by detection circuit in FIG. 1, according to some embodiments.

Referring to FIG. 2, in operation S210, the detection circuit 140 compares a ratio Px/Pn with a threshold value TH1, in which the ratio Px/Pn is a ratio of the power Px of the reference signal X(n) to the power Pn of the noise signal V2(*n*). As noted above, the signal strength of the noise signal V2(*n*) is used as the analogy of the signal strength of the noise signal V(n). If the ratio Px/Pn is greater than the threshold value TH1, operation S220 is performed. If the ratio Px/Pn is less than the threshold value TH1, operation S215 is performed. In operation S215, the filter 124 is selected to provide the transfer function H2(*z*) to process the digital signal Y(n), in order to output the noise cancellation signal NC(n).

For example, when the ratio Px/Pn is less than the threshold value TH1, it indicates that the reference signal X(n) is significantly less than the noise signal V(n). Under this condition, the detection circuit 140 determines that the unknown position is present, and outputs the switching signal SE to select the filter 124. As a result, it is ensured that the noise cancellation device 100 is kept being stable.

In operation S220, the detection circuit 140 compares a ratio Py/Pu with a threshold value TH2, in which the ratio Py/Pu is a ratio of the power Py of the digital signal Y(n) to the power Pu of the mixed signal U(n). If the ratio Py/Pu is greater than the threshold value TH2, operation S230 is performed. If the ratio Py/Pu is less than the threshold value TH2, operation S215 is performed. In operation S230, the filter 122 is selected to provide the transfer function H1($z$) to process the digital signal Y(n), in order to output the noise cancellation signal NC(n).

For example, when the ratio Py/Pu is greater than the threshold value TH2, it indicates that the transfer function S(z) has a higher value. As noted above, in the on-ear position, the transfer function S(z) has the higher value. Accordingly, under this condition, the detection circuit 140 determines that the device 100 is in the on-ear position, and outputs the switching signal SE to select the filter 122. As a result, the noise cancellation quality of the noise cancellation device 100 is increased.

Alternatively, when the ratio Py/Pu is less than the threshold value TH2, it indicates that the transfer function S(z) has a lower value. As noted above, in the off-ear position, the transfer function S(z) has the lower value. Accordingly, under this condition, the detection circuit 140 determines that the device 100 is in the off-ear position, and outputs the switching signal SE to select the filter 124. As a result, it is ensured that the noise cancellation device 100 is kept being stable.

Figure 3:
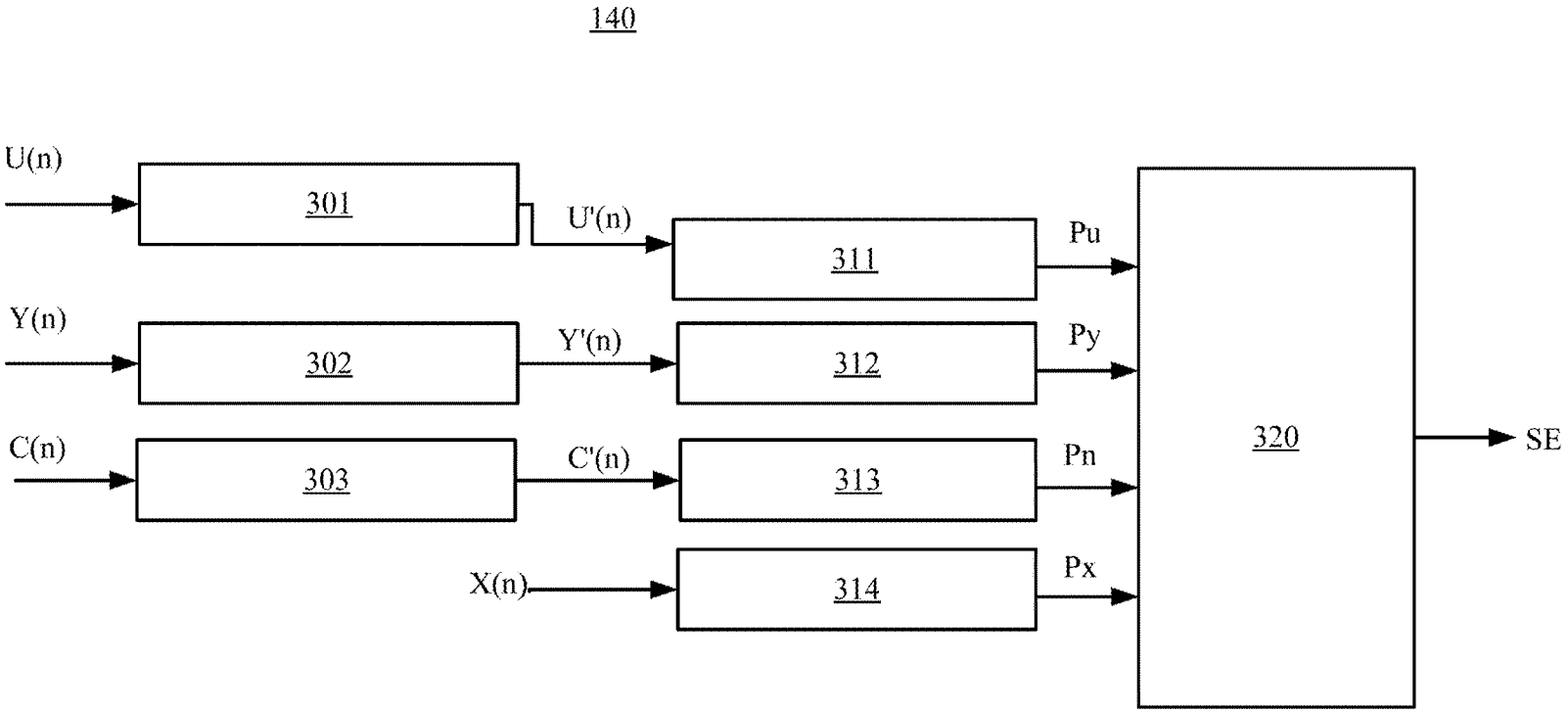
FIG. 3 is a circuit diagram of detection circuit in FIG. 1, according to some embodiments.

In some embodiments, the power Px and the power Pn are the power of the reference signal X(n) and the power of the noise signal V2($n$) at the frequency of the reference signal X(n), respectively. In some embodiments, the power Px, the power Pn, the power Py, and the power Pu are the power of the reference signal X(n), the power of the noise signal V2($n$), the power of the digital signal Y(n), and the mixed signal U(n) at the frequency of the reference signal X(n), respectively. Referring to FIG. 3, the detection circuit 140 includes bandpass filters 301-303, power estimator circuits 311-314, and a logic circuit 320.

Each of the bandpass filters 301-303 provides a predetermined bandwidth to process a corresponding one of the mixed signal U(n), the digital signal Y(n), and the digital noise signal C(n). For example, the bandpass filter 301 filters signal components, which have frequencies other than the frequency of the reference signal X(n), in the mixed signal U(n), in order to output a signal U'(n). The bandpass filter 302 filters out signal components, which have frequencies other than the frequency of the reference signal X(n), in the digital signal Y(n), in order to output a signal Y'(n). The bandpass filter 303 filters out signal components, which have frequencies other than the frequency of the reference signal X(n), in the digital noise signal C(n), in order to output a signal C'(n).

The power estimator circuit 311 determines the power Pu of the signal U'(n). The power estimator circuit 312 determines the power Py of the signal Y'(n). The power estimator circuit 313 determines the power Pn of the signal C'(n). The power estimator circuit 314 determines the power Px of the reference signal X(n).

In some embodiments, the power estimator circuits 311-314 may be implemented with power detectors. In some embodiments, the power estimator circuits 311-314 may be implemented with arithmetic circuits that perform various algorithms for determining power. The above implementations are given for illustrative purposes only, and the present disclosure is not limited thereto.

The logic circuit 320 determines the ratio Py/Pu and the ratio Px/Pn according to the powers Pu, Py, Pn, and Px, in order to perform operations in the method 200 to generate the corresponding switching signal SE. In some embodiments, the logic circuit 320 is implemented with various digital circuits, processing units, or micro-controllers.

Figure 4A:
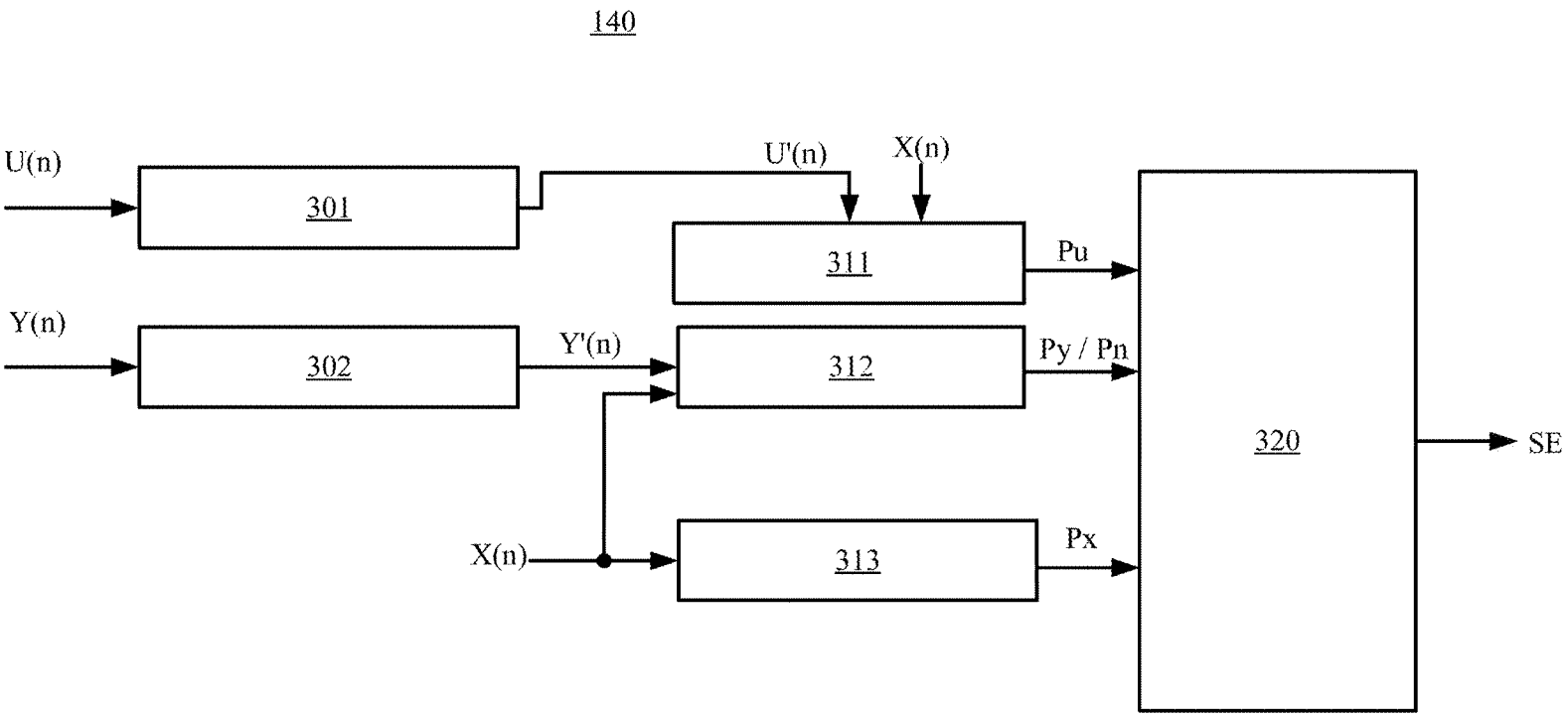
FIG. 4A is a circuit diagram of detection circuit in FIG. 1, according to some other embodiments.
Figure 4B:
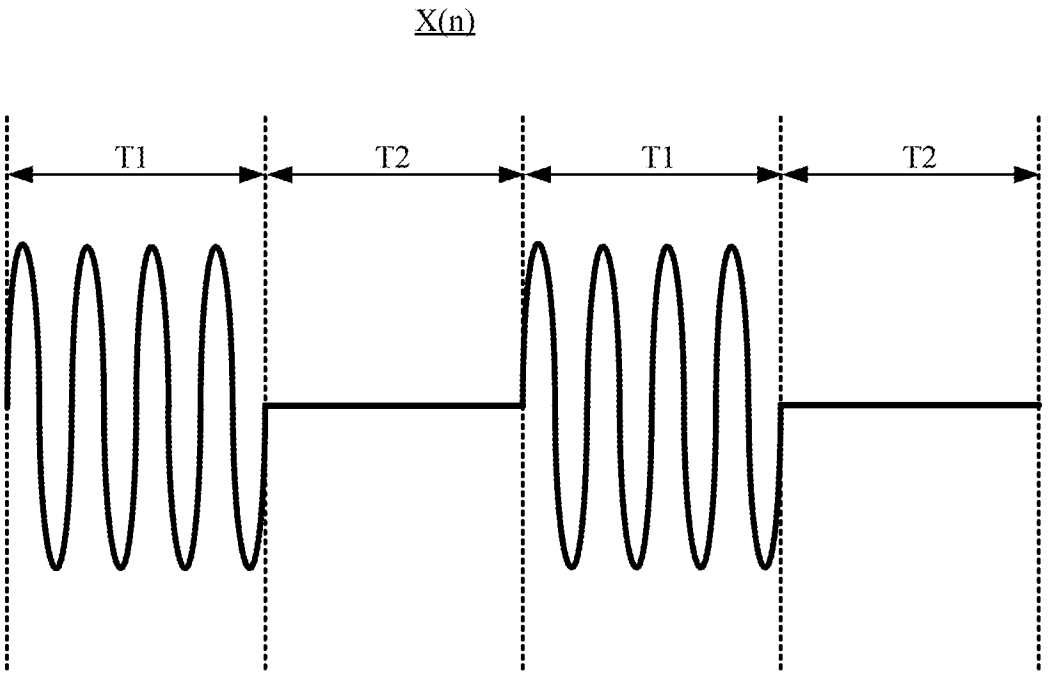
FIG. 4B is a schematic diagram illustrating waves of reference signal in FIG. 4A, according to some embodiments.

Reference is made to FIGS. 4A and 4B. For ease of understanding, like elements in FIGS. 4A and 4B are designated with the same reference numbers with respect to FIGS. 1-3.

In some embodiments, the noise cancellation device 100 may determine the power Pn of the noise signal V(n) without the audio-to-electric conversion device 155 and the ADC 115. In this example, as shown in FIG. 4B, the reference signal X(n) is configured to have an enabling period T1 and a disabling period T2. During the enabling period T1, the reference signal X(n) generates a frequency that cannot be sensed by human ear. During the disabling period T2, the amplitude of the reference signal X(n) is set to be zero. According to the equation (1), it is able to derive the following equation (4) during the disabling period T2:

$$Y(z) \approx V(z)\left[\frac{1}{1+S(z)H(z)}\right] \rightarrow V(z) \approx Y(z)[1+S(z)H(z)]. \tag{4}$$

Therefore, in some embodiments, the detection circuit 140 may determine the Pn of the noise signal V(n) according to the digital signal Y(n) and the equation (4). In some embodiments, the transfer function S(z) of the equation (4) is set to one of the transfer functions, corresponding to the on-ear position and the off-ear position, which has a larger value.

For example, as shown in FIG. 4A, the detection circuit 140 includes the bandpass filters 301-302, the power estimator circuits 311-313, and the logic circuit 320.

Compared with FIG. 3, in this example, the power estimator circuit 311 further determines, according to the signal U'(n), the power Pu of the mixed signal U(n) at the frequency of the reference signal X(n) during the enabling period T1 of the reference signal X(n). The power estimator circuit 312 further determines, according to the signal Y'(n), the power Py of the digital signal Y(n) at the frequency of the reference signal X(n) during the enabling period T1 of the reference signal X(n), and determines, according to the signal Y'(n) and the equation (4), the power Pn of the noise signal V(n) at the frequency of the reference signal X(n) during the disabling period T2 of the reference signal X(n). The power estimator circuit 313 further determines, according to the reference signal X(n), the power Px of the reference signal X(n) during the enabling period T1 of the reference signal X(n).

In some embodiments, instead of receiving the reference signal X(n), the power estimator circuits 311-313 may directly receive clock signals to which the enabling period T1 and the disabling period T2 of the reference signal X(n) correspond. For example, when the reference signal X(n) is in the enabling period T1, the corresponding clock signal is 1 (or 0), and when the reference signal X(n) is in the disabling period T2, the corresponding clock signal is 0 (or 1).

The circuit components in the noise cancellation device 100 as illustrated in the above embodiments can be implemented with software, hardware, or a combination thereof. For example, the components in the anti-noise filter circuit 120 and/or the detection circuit 140 can be implemented with digital signal processing.

As described above, the noise cancellation device 100 and the 200 provided in the present disclosure are able to analyze the on-ear position and the off-ear position with different arrangements, in order to selectively employ an appropriate filter to improve the performance of an audio processing system.

What is claimed is:

1. A noise cancellation device, comprising:

an anti-noise filter circuit configured to provide a corresponding one of transfer functions to process a digital signal, in order to generate a noise cancellation signal, wherein the transfer functions are different from each other;

an output circuit configured to mix the noise cancellation signal, a reference signal, and an input signal to generate a mixed signal, and configured to generate a sound output signal based on the mixed signal, wherein the digital signal is associated with the sound output signal; and a detection circuit configured to control the anti-noise filter circuit to provide the corresponding one of the transfer functions according to a comparison result of a first ratio and a first threshold value, wherein the first ratio is a ratio of a first power of the mixed signal to a second power of the digital signal.

2. The noise cancellation device of claim 1, wherein the transfer functions comprise a first transfer function and a second transfer function, a voltage gain of the first transfer function is higher than a voltage gain of the second transfer function, and wherein if the first ratio is greater than the first threshold value, the anti-noise filter circuit is configured to provide the first transfer function, and if the first ratio is less than the first threshold value, the anti-noise filter circuit is configured to provide the second transfer function.

3. The noise cancellation device of claim 2, wherein the detection circuit is configured to determine that the noise cancellation device is in an on-ear position if the first ratio is greater than the first threshold value, and is configured to determine that the noise cancellation device is in an off-ear position if the first ratio is less than the first threshold value.

4. The noise cancellation device of claim 2, further comprising:

a first analog-to-digital converter configured to convert a first electrical signal to the digital signal, wherein the first electrical signal is associated with the sound output signal and a noise signal.

5. The noise cancellation device of claim 4, wherein the detection circuit is further configured to compare a second ratio with a second threshold value, in order to control the anti-noise filter circuit to provide the second transfer function if the second ratio is less than the second threshold value, wherein the second ratio is ratio of a third power of the reference signal to a fourth power of the noise signal, and the detection circuit is further configured to compare the first ratio with the first threshold value if the second ratio is greater than the second threshold value.

6. The noise cancellation device of claim 5, wherein the detection circuit comprises:

a plurality of bandpass filters configured to process the mixed signal, the digital signal, and a digital noise signal, respectively, wherein the digital noise signal is used to estimate a power of the noise signal;

a plurality of power estimator circuits configured to determine the first power, the second power, the third power, and the fourth power according to the processed mixed signal, the processed digital signal, the reference signal, and the processed digital noise signal, respectively; and a logic circuit configured to determine the first ratio according to the first power and the second power, and to determine the second ratio according to the third power and the fourth power, wherein the logic circuit is further configured to compare the first ratio with the first threshold value, and to compare the second ratio and the second threshold value, in order to control the anti-noise filter circuit.

7. The noise cancellation device of claim 6, further comprising:

a second analog-to-digital converter configured to convert a second electrical signal to the digital noise signal.

8. The noise cancellation device of claim 7, further comprising:

a first audio-to-electric conversion device configured to receive the sound output signal and the noise signal and to generate the first electrical signal; and a second audio-to-electric conversion device configured to receive the noise signal and to generate the second electrical signal.

9. The noise cancellation device of claim 5, wherein the reference signal has an enabling period and a disabling period, and the detection circuit comprises:

a plurality of bandpass filters configured to process the mixed signal and the digital signal, respectively;

a first power estimator circuit configured to, according to the processed mixed signal, determine the first power during the enabling period;

a second power estimator circuit configured to, according to the processed digital signal, determine the second power during the enabling period, and to, according to the processed digital signal, determine the fourth power during the disabling period;

a third power estimator circuit configured to, according to the reference signal, determine the third power during the enabling period; and a logic circuit configured to determine the first ratio according to the first power and the second power, and to determine the second ratio according to the third power and the fourth power, wherein the logic circuit is further configured to compare the first ratio and the first threshold value, and to compare the second ratio with the second threshold value, in order to control the anti-noise filter circuit.

10. The noise cancellation device of claim 1, wherein the output circuit comprises:

an arithmetic circuit configured to mix the noise cancellation signal, the reference signal, and the input signal to generate the mixed signal;

a digital-to-analog converter configured to convert the mixed signal; and an electric-to-audio conversion device configured to output the sound output signal according to the converted mixed signal.

11. A noise cancellation method, comprising:

controlling an anti-noise filter circuit to provide a corresponding one of transfer functions to process a digital signal, in order to generate a noise cancellation signal, wherein the transfer functions are different from each other;

mixing the noise cancellation signal, a reference signal, and an input signal to generate a mixed signal, and generating a sound output signal based on the mixed signal, wherein the digital signal is associated with the sound output signal; and controlling the anti-noise filter circuit to provide the corresponding one of the transfer functions according to a comparison result of a first ratio and a first threshold value, wherein the first ratio is a ratio of a first power of the mixed signal to a second power of the digital signal.

12. The noise cancellation method of claim 11, wherein the transfer functions comprise a first transfer function and a second transfer function, a voltage gain of the first transfer function is higher than a voltage gain of the second transfer function, and the controlling an anti-noise filter circuit to provide a corresponding one of transfer functions comprises:

providing the first transfer function if the first ratio is greater than the first threshold value; and providing the second transfer function if the first ratio is less than the first threshold value.

13. The noise cancellation method of claim 12, wherein an on-ear position is determined if the first ratio is greater than the first threshold value, and an off-ear position is determined if the first ratio is less than the first threshold value.

14. The noise cancellation method of claim 12, further comprising:

converting a first electrical signal to the digital signal, wherein the first electrical signal is associated with the sound output signal and a noise signal.

15. The noise cancellation method of claim 14, further comprising:

comparing a second ratio with a second threshold value, in order to control the anti-noise filter circuit to provide the second transfer function if the second ratio is less than the second threshold value, wherein the second ratio is a ratio of a third power of the reference signal to a fourth power of the noise signal; and comparing the first ratio with the first threshold value of the second ratio is greater than the first threshold value.

16. The noise cancellation method of claim 15, wherein controlling the anti-noise filter circuit to provide the corresponding one of the transfer functions according to the comparison result comprises:

processing, by a plurality of bandpass filters, the mixed signal, the digital signal, and a digital noise signal, respectively, wherein the digital noise signal is used to estimate a power of the noise signal;

determining the first power, the second power, the third power, and the fourth power according to the processed mixed signal, the processed digital signal, the reference signal, and the processed digital noise signal, respectively;

determining the first ratio according to the first power and the second power, and determining the second ratio according to the third power and the fourth power; and comparing the first ratio with the first threshold value, and comparing the second ratio and the second threshold value, in order to control the anti-noise filter circuit.

17. The noise cancellation method of claim 16, further comprising:

converting a second electrical signal to the digital noise signal.

18. The noise cancellation method of claim 17, further comprising:

receiving, by a first audio-to-electric conversion device, the sound output signal and the noise signal, and generating the first electrical signal; and receiving, by a second audio-to-electric conversion device, the noise signal, and generating the second electrical signal.

19. The noise cancellation method of claim 15, wherein the reference signal has an enabling period and a disabling period, and controlling the anti-noise filter circuit to provide the corresponding one of the transfer functions according to the comparison result comprises:

processing, by a plurality of bandpass filters, the mixed signal and the digital signal, respectively;

determining the first power according to the processed mixed signal during the enabling period;

determining the second power according to the processed digital signal, during the enabling period;

determining the third power according to the reference signal during the enabling period;

determining the fourth power according to the processed digital signal during the disabling period;

determining the first ratio according to the first power and the second power, and determining the second ratio according to the third power and the fourth power; and comparing the first ratio with the first threshold value, and comparing the second ratio with the second threshold value, in order to control the anti-noise filter circuit.

20. The noise cancellation method of claim 11, wherein generating the sound output signal comprises:

mixing the noise cancellation signal, the reference signal, and the input signal to generate the mixed signal;

converting the mixed signal; and outputting, by an electric-to-audio conversion device, the sound output signal according to the converted mixed signal.

* * * * *